US011820592B2

(12) United States Patent
Xu

(10) Patent No.: US 11,820,592 B2
(45) Date of Patent: Nov. 21, 2023

(54) INTELLIGENT STERILIZATION, DEODORIZATION AND CARBON-RELEASING REDUCTION GARBAGE BIN

(71) Applicant: Bugu Calling Technology (Hangzhou) Co., Ltd., Hangzhou (CN)

(72) Inventor: Tian Xu, Hangzhou (CN)

(73) Assignee: BUGU CALLING TECHNOLOGY (HANGZHOU) CO., LTD., Hangzhou (CN)

( * ) Notice: Subject to any disclaimer, the term of this patent is extended or adjusted under 35 U.S.C. 154(b) by 0 days.

(21) Appl. No.: 17/832,685

(22) Filed: Jun. 6, 2022

(65) Prior Publication Data

US 2023/0142447 A1 May 11, 2023

(30) Foreign Application Priority Data

Nov. 11, 2021 (CN) ..... 202111334012.4

(51) Int. Cl.
*B65F 7/00* (2006.01)
*B65F 1/08* (2006.01)
(Continued)

(52) U.S. Cl.
CPC ..... *B65F 7/00* (2013.01); *B65F 1/06* (2013.01); *B65F 1/085* (2013.01); *B65F 2210/129* (2013.01); *B65F 2210/165* (2013.01)

(58) Field of Classification Search
CPC .... B65F 7/00; B65F 1/085; B65F 1/16; B65F 2210/129; B65F 2210/165
(Continued)

(56) References Cited

U.S. PATENT DOCUMENTS 3,759,416 A * 9/1973 Constantine ..... B65D 21/0219 206/508
7,516,865 B1 * 4/2009 Pierre ..... B65F 7/00 220/908

(Continued)

FOREIGN PATENT DOCUMENTS

CN 208233859 U * 12/2018
CN 211418370 U 9/2020

*Primary Examiner* — Rafael A Ortiz
*Assistant Examiner* — Sanjidul Islam
(74) *Attorney, Agent, or Firm* — Zhigang Ma

(57) ABSTRACT

An intelligent sterilization, deodorization and carbon-releasing reduction garbage bin includes a bin body, a bin cover disposed on the bin body, a solution storage chamber and a spray head. The spray head is disposed on a wall of the bin body or on the bin cover. By disposing an inner bucket and/or a garbage bag each with a liquid storage cavity, a molding groove, the liquid storage chamber, the spray head and an intelligent control device, the solution storage chamber being for storing a sterilization and deodorization solution, and the spray head being for spraying the solution stored in the liquid storage chamber, which can filter out water in garbage uninterruptedly and spray a special liquid with effects of sterilization, deodorization and carbon-releasing reduction into the garbage as needed and in an automatic timed and quantitative manner, thereby comprehensively playing multiple beneficial effects in sterilization, deodorization and carbon-releasing reduction.

13 Claims, 7 Drawing Sheets

(51) Int. Cl.
*B65F 1/16* (2006.01)
*B65F 1/06* (2006.01)

(58) Field of Classification Search
USPC ..... 239/518, 512, 523, 332; 220/380, 908, 220/47.1, 47.2
See application file for complete search history.

(56) References Cited

U.S. PATENT DOCUMENTS

| | | | | |
|---|---|---|---|---|
| 9,309,048 | B2 * | 4/2016 | Mashburn | B65F 1/06 |
| 9,334,118 | B1 * | 5/2016 | Tanner | B65G 11/203 |
| 2011/0226767 | A1 * | 9/2011 | Ekchian | B65F 7/00 220/200 |
| 2016/0083178 | A1 * | 3/2016 | Goff | B65F 1/062 220/86.1 |
| 2020/0391939 | A1 * | 12/2020 | Wang | A61L 2/22 |
| 2022/0390916 | A1 * | 12/2022 | Gordon | G05B 19/0426 |

* cited by examiner

INTELLIGENT STERILIZATION, DEODORIZATION AND CARBON-RELEASING REDUCTION GARBAGE BIN

TECHNICAL FIELD

The present disclosure relates to the field of garbage, and more particularly to an intelligent sterilization, deodorization and carbon-releasing reduction garbage bin.

BACKGROUND

Organic garbage containing moisture or water (also known as kitchen garbage or wet garbage) is easy to generate odor during stacking, contains a large number of harmful or pathogenic microorganisms, and releases a large amount of carbonaceous substances. In order to reduce the amount of odor generation and inhibit activities of microorganisms during the stacking of garbage, a patent publication document CN211418370U discloses a garbage bag and its holding and attachment device. In this document, the garbage bag filters out water or liquid components contained in the garbage to reduce activity intensities of microorganisms, thereby achieving purposes of reducing the generation of odor and inhibiting activities of microorganisms. However, this kind of garbage bag only filters out most of the water in the garbage, efficiencies of deodorization and microorganism inhibition are relatively low, and thus cannot achieve comprehensive multiple effects of sterilization, deodorization and carbon-releasing reduction. In addition, the patent publication document CN211418370U (with an assignee same as that of the present disclosure) discloses a liquid storage cavity in a garbage bin is arranged under a movable plate to separate an accommodating cavity and a liquid storage cavity of the garbage bag and support the weight of the garbage in the accommodating cavity. However, this design would significantly increase the manufacturing difficulty, and when in use, the movable plate at the bottom of the garbage bin must be turned up in order to place the liquid storage cavity of the garbage bag under the movable plate in advance, which would cause great inconvenience or trouble.

SUMMARY

Aiming to the above problems in the related art, the present disclosure proposes an intelligent sterilization, deodorization and carbon-releasing reduction garbage bin.

Technical solutions provided by the present disclosure are as follows.

An intelligent sterilization, deodorization and carbon-releasing reduction garbage bin includes: a bin body, a bin cover, a solution storage chamber, and a spray head. The bin cover is disposed on the bin body. The solution storage chamber is connected to the spray head. The spray head is set up on a wall of the bin body or on the bin cover through a connection structure.

It is noted that, the garbage bin of the present disclosure generally is used together with a garbage bag or an inner bucket. The garbage bag is placed in the bin body and for accommodating garbage. The inner bucket also is placed in the bin body and for accommodating garbage. The garbage bag and the inner bucket may be used at the same time, i.e., the inner bucket is placed in the bin body and the garbage bag is sleeved in the inner bucket.

In the intelligent sterilization, deodorization and carbon-releasing reduction garbage bin of the present disclosure, the solution storage chamber and the spray head are disposed through the connection structure, the solution storage chamber is used to store a mixture solution with effects of sterilization, deodorization and carbon-releasing reduction, and the spray head is used to spray the mixture solution stored in the solution storage chamber. When in use, the garbage bag, or the inner bucket, or both the garbage bag and the inner bucket sleeved together is/are placed in the bin body, and then the solution sprayed from the spray head can enter into the garbage bag or the inner bucket through an opening on the garbage bag, or through a groove/hole on the bin body or directly. When in use, garbage such as kitchen waste are thrown into the inner bucket or the garbage bag, and then the spray head is used to spray a sterilization and deodorization solution stored in the solution storage chamber towards the garbage to greatly kill harmful microorganisms and reduce the production of odor and the emission of carbon dioxide and methane under the effect of sterilization and deodorization solution.

A molding groove may be disposed at the bottom of the intelligent sterilization, deodorization and carbon-releasing reduction garbage bin. The molding groove is located inside the bin body. When cooperating with the garbage bag disclosed in the patent publication document CN211418370U or the inner bucket of the present disclosure, the molding groove can accommodate a liquid storage cavity of one of the garbage bag and the inner bucket, and bin bottom (inclined) plates on both sides of the molding groove can support the weight of the garbage in the bin body, so that most of water in the garbage can be automatically filtered out by gravity continuously and thereby playing a role of slowing down fermentation, decay and mildew. Moreover, when using an intelligent control system on a circuit board, as needed or in automatic timed and quantitative manner, to timely spray the mixture solution with effects of sterilization, deodorization and carbon-releasing reduction into the garbage bag or the inner bucket, it can further enhance the effects of sterilization, deodorization and carbon-releasing reduction on the garbage in the bag or the inner bucket. In addition, when the mixture solution penetrates downwardly into the liquid storage cavity, it can play an inhibition role again on parts with the most potential of fermentation, decay and mildew. Furthermore, the cavities at the bottom of the bin body and a dual gap between the garbage bag and/or the inner bucket and the bin body form two spaces for blocking air heat conduction, which can further reduce the process of fermentation, decay and mildew caused by heat. A combined action of multiple automatic sterilization, deodorization and carbon-releasing reduction cleverly combined together can effectively inhibit activities of microorganisms in fermentation, decay and mildew of organic substances, and yield unpredictable multiple effects.

Since the intelligent sterilization, deodorization and carbon-releasing reduction garbage bin can be used together with the garbage bag disclosed in the patent publication document CN211418370U, and the garbage bag disclosed in the patent publication document CN211418370U has a liquid storage cavity, therefore the bottom of the bin body is disposed with the molding groove, and the molding groove is used to receive the liquid storage cavity of the garbage bag or the inner bucket. Due to the existence of the molding groove, it can position the liquid storage cavity to avoid the liquid in the liquid storage cavity mixing with the organic waste in the bag again. The bin bottom (inclined) plates on both sides of the molding groove, together with clamping of the bin cover and holding of hook tabs, can make the garbage in the garbage bag better supported and secured in the bin body.

The molding groove may be a linear groove, or a S-shaped groove, or a Z-shaped groove. Non-linear groove can increase the length of the molding groove as much as possible within limited length and width of the bottom of the bin body, thereby accommodating the liquid storage cavity of the garbage bag as much as possible.

Because the molding groove is disposed at the bottom of the bin body, and the liquid storage cavity of the garbage bag is located in the molding groove, garbage in the accommodating cavity of the garbage bag is mainly supported by the bin bottom plates of the bin body. This design can prevent the garbage bag from cracking due to excessive weight of the garbage in the bag.

The solution storage chamber may be a portion of the bin body, or may be an individual solution storage chamber additionally disposed inside or outside the bin body through the connection structure.

In an embodiment, cavities are defined at the bottom of the bin body and located outside the bin body, and the cavities are arranged along peripheral edges of the molding groove.

Due to the cavities are disposed outside the bin body and arranged along the peripheral edges of the molding groove, and the cavities have a certain heat insulation effect, it can reduce or suppress heat convection between air outside the bin body and liquid inside the molding groove, so that in high-temperature weather, it can play a certain heat insulation effect on the liquid inside the molding groove and slow down the process of liquid stinking.

In an embodiment, the garbage bin further includes a hanging hook. The hanging hook is detachably disposed on a bin wall of the bin body, and the solution storage chamber is detachably disposed on the hanging hook.

The role of disposing the hanging hook is to install the solution storage chamber, and the solution storage chamber is hung on the bin wall of the bin body by the hanging hook, such design is convenient to remove the solution storage chamber from the bin body at any time according to the need. The hanging hook is used for installation, on one hand, it is easy to disassemble at any time, and on the other hand, it would not damage the garbage bag. Compared with traditional fixing methods such as fixed type, Velcro type and snap type, installation through the hanging hook is more convenient and faster or reliable. Moreover, it is very convenient for cleaning, repair and maintenance of the garbage bin and the solution storage chamber. For example, when the automatic spraying function of the solution storage chamber is failed, the solution storage chamber can be easily taken down and sent directly to a maintenance point for repair, which can greatly avoid the consumption of manpower and time of on-door repair.

In an embodiment, the garbage bin further includes an electric pump, a battery, and a control circuit board a chip. The solution storage chamber is connected to the spray head through the electric pump. The electric pump, the battery and the control circuit board are disposed on the solution storage chamber. The battery and the electric pump are electrically connected to the control circuit board.

The role of the battery and the electric pump is to pump the sterilization and deodorization mixture solution stored in the solution storage chamber to the spray head, and then the mixture solution is sprayed out by the spray head. The control circuit board is used to control the battery and the electric pump, and the control circuit board can be programmed according to a need to regulate and control the battery and the electric pump, and a spraying amount and a spraying time of the sterilization and deodorization solution can be set through programming. A remote controller may be provided to control functions of the control circuit board wirelessly. The remote controller can also be responsible for controlling a movement of the garbage bin through a power device and a moving device disposed on the garbage bin.

In addition, a key-press board may be disposed on the control circuit board. The key-press board is made of a soft rubber. The key-press board is disposed with an end hole for clamping a USB interface, and meanwhile one side of the key-press board is disposed with an end cover for sealing the end hole. Moreover, the key-press board is disposed soft column thereon, and touch keys on the control circuit board can be pressed through the soft columns. The existence of the key-press board can play a good role in waterproofing the control circuit board and effectively protect the keys from damage caused by heavy objects.

In an embodiment, the bin body is disposed hook tabs thereon.

The role of the hook tabs is to hook a garbage bag through holding holes on the garbage bag, so as to play a role of holding the garbage bag and thereby avoid the garbage bag from slipping into the bin body when throwing garbage into the garbage bag.

The hook tabs are specifically disposed at a bin opening of the bin body and located outside the bin body, so that when taking out the garbage bag, it can avoid unpleasant or uncomfortable feeling caused by direct hand contact with the garbage inside the bag.

In an embodiment, the bin cover includes a frame and a cover plate. One end of the cover plate is rotatably mounted on the frame. Moreover, devices such as a sensor and a motor which can automatically open and close the cover plate can be disposed on the frame.

Specifically, the frame is used to clamp with the bin mouth of the bin body, in addition to fixing the bin cover to prevent sliding, it can clamp the garbage bag tightly. One end of the cover plate is rotatably engaged with the frame through a pin shaft, and the role of the cover plate is used to close the bin body.

In an embodiment, a nozzle of the spray head is inclined towards a bin bottom side of the bin body.

Since the nozzle of the spray head faces towards the bin bottom side of the bin body, it can ensure that the sterilization and deodorization solution sprayed from the spray head can be sprayed towards the garbage effectively.

Specifically, the spray head may be an atomization sprayer, and liquid leaving the nozzle of the spray head is atomized sterilization and deodorization solution. For such operation, it can make the atomized sterilization and deodorization solution fully enter into the garbage bin, and moreover atomized droplets can adsorb particles with microorganisms as well as dust in the air in the bin body, which facilitates the particles and dust in the garbage to form larger particles and then fall into the garbage bag, thereby avoiding particles with microorganisms and dust to be raised to pollute external environment.

In an embodiment, the garbage bin further includes a spray seat. The spray seat is disposed on the solution storage chamber, and the spray head is clamped/mounted on the spray seat.

Specifically, the spray seat is mainly used to clamp and fix the spray head, and may further be equipped with a liquid guide plate, a three-way groove, a wiring groove serving as pipe groove as well as wire groove, and a support block. Therefore, the spray seat may have multiple functions such as positioning and supporting a lid of the solution storage (spraying) chamber.

In an embodiment, the spray seat is disposed an arc-shaped liquid guide plate thereon.

In particular, the spray seat is provided with a clamping hole, the spray head is clamped in the clamping hole of the spray seat, and the liquid guide plate is arranged at a mouth on one side of the clamping hole. When in use, the liquid guide plate can be used to pass through a bag hole of a wall of the garbage bag. In the process of spraying atomized liquid, the liquid guide plate can guide the liquid to ensure that the atomized liquid is sprayed towards the bottom of the garbage bag through the liquid guide plate, and meanwhile in the process of spraying atomized liquid, some atomized liquid will leak from the spray head, the existence of the liquid guide plate can collect the leaked liquid and introduce it into the garbage, thereby avoiding the leaked liquid to be left between the bin wall of the bin body and the garbage bag, and also playing the role of positioning the bag hole of the garbage bag.

Beneficial effects can be achieved by the present disclosure are that: by disposing the garbage bag and/or the inner bucket with the liquid storage cavity, the molding groove, the solution storage chamber, the spray head and the intelligent control device, the solution storage chamber is used to store the sterilization and deodorization solution, and the spray head is used to spray out the sterilization and deodorization solution stored in the solution storage chamber; which can filter out water from garbage uninterruptedly and spray a special liquid with effects of sterilization, deodorization and carbon-releasing reduction to the garbage as needed or in an automatic timed and quantitative manner. The special liquid penetrates downwardly into the liquid storage cavity to function again. The cavities at the bottom of the bin body and gaps between the garbage bag and/or the inner bucket and the bin body form dual air heat conduction blockings. The combined effect of multiple ingenious combinations of automatic sterilization and deodorization and carbon-releasing reduction can effectively kill or inhibit activities of microorganisms in fermentation, decay and mildew of organic substances, kill harmful microorganisms, and reduce the generation of odor and the emission of carbon dioxide and methane.

Figure 1:
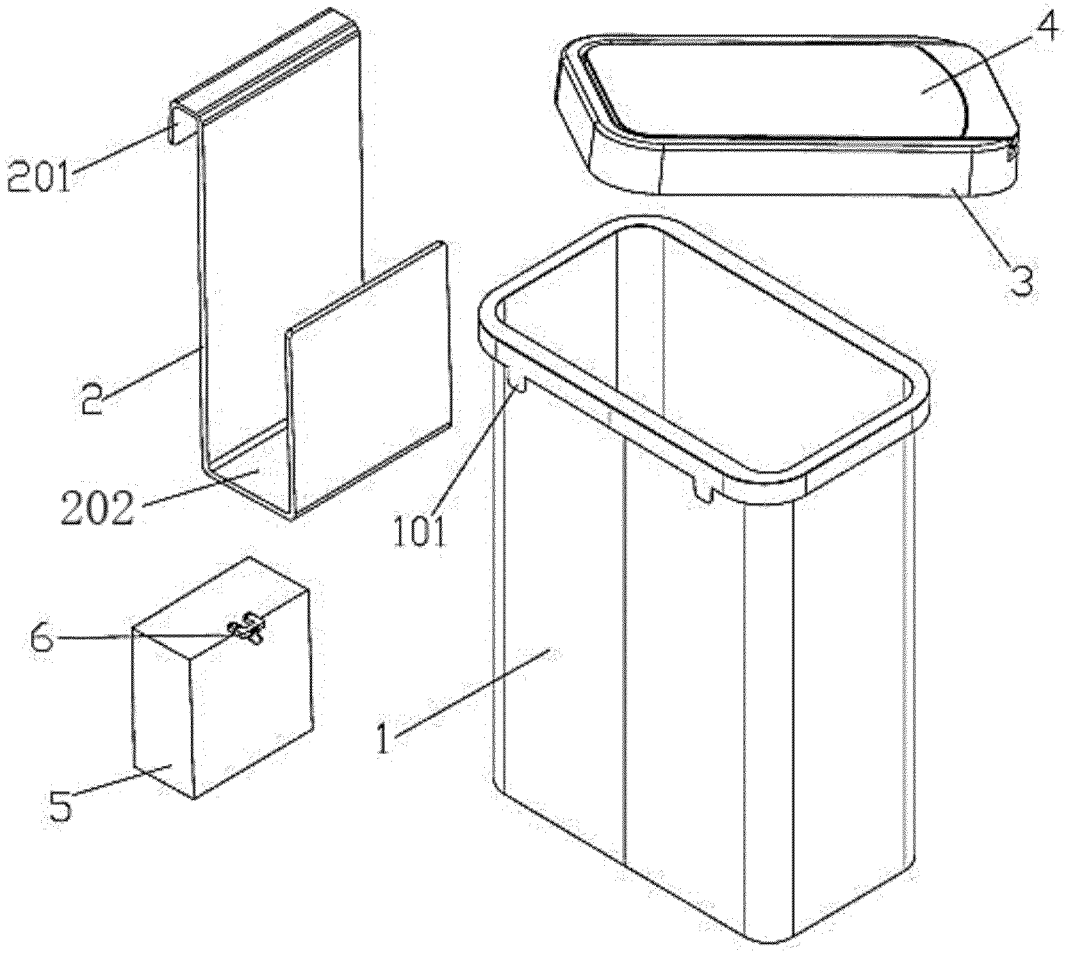
FIG. 1 illustrates a schematic relationship among a bin body, a bin cover and a hanging hook.
Figure 2:
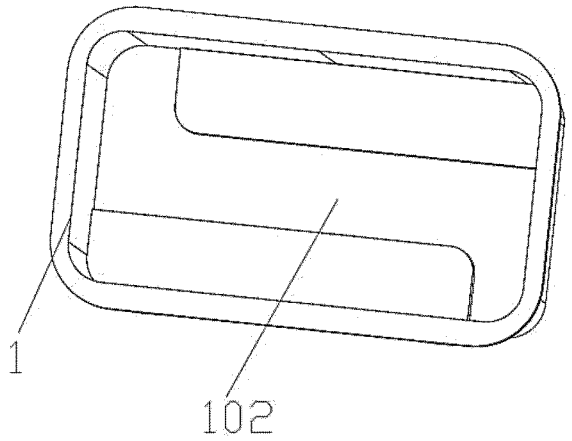
FIG. 2 illustrates a schematic structural view of the bin body.
Figure 3:
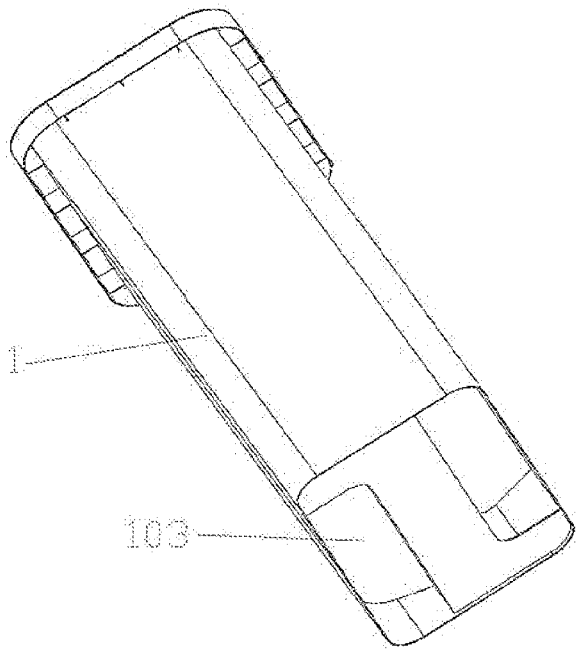
FIG. 3 illustrates a schematic view showing positions of cavities defined on the bin body.
Figure 4A:
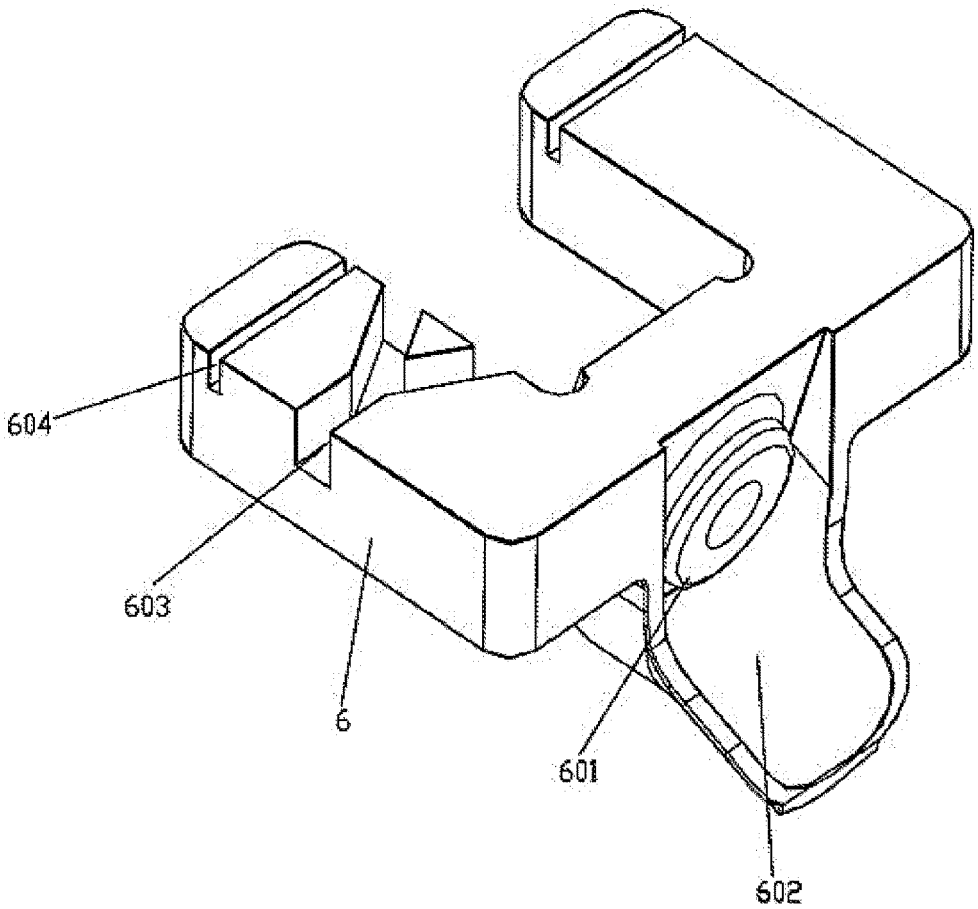
FIG. 4A illustrates a schematic structural view of a spray seat.
Figure 4B:
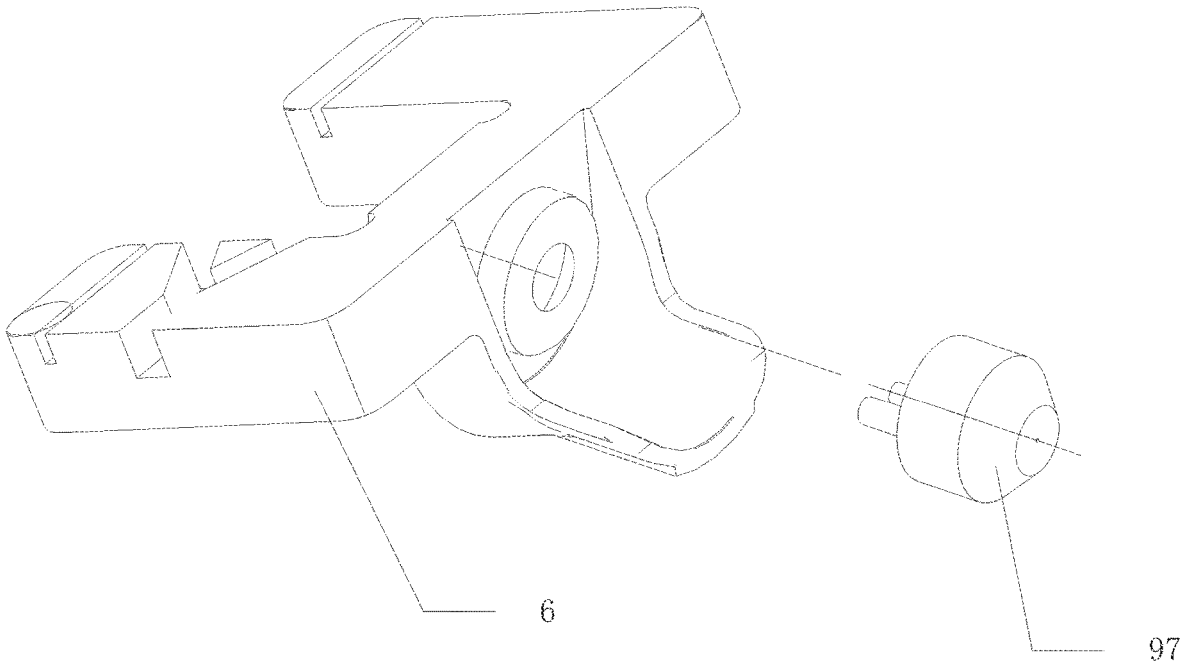
FIG. 4B illustrates a schematic structural view of a spray seat and a spray head in an unassembled state.
Figure 4C:
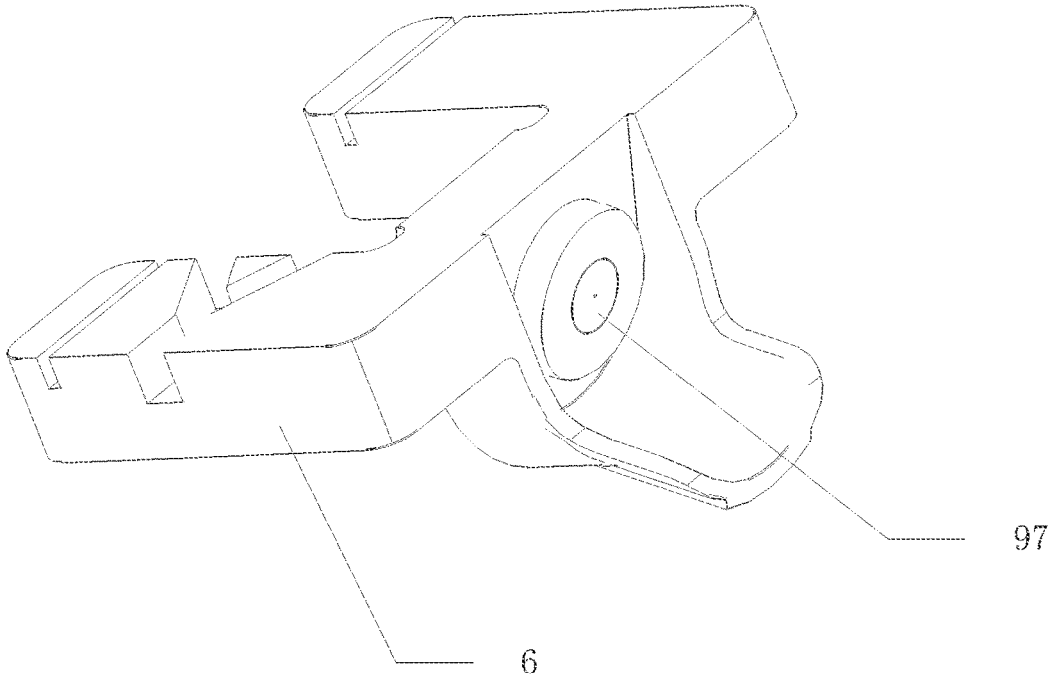
FIG. 4C illustrates a schematic structural view of the spray seat and the spray head in an assembled state.

Description of reference numerals: 1, bin body; 101, hook tab; 102, molding groove; 103, cavity; 2, hanging hook; 201, suspension hook portion; 202, load-bearing hook portion; 3, frame; 4, cover plate; 5, solution storage chamber; 6, spray seat; 601, clamping hole; 602, liquid guide plate; 603, three-way groove; 604, wiring groove; 7, inner bucket; 701, liquid storage cavity; 702, step; 703, handle; 8, key-press board; 801, end hole; 802, soft column; 803, end cover; 91, electric pump; 93, control circuit board; 95, battery; 97, spray head.

DETAILED DESCRIPTION OF EMBODIMENTS

The present disclosure will be described in detail below with reference to the accompanying drawings.

Embodiment 1

An intelligent sterilization, deodorization and carbon-releasing reduction garbage bin includes: a bin body 1, and a bin cover. The bin cover is disposed on the bin body 1. The garbage bin may further include a solution storage chamber 5 and a spray head 97. The solution storage chamber 5 is connected to the spray head 97, and the spray head 97 is disposed on an inner wall of the bin body 1.

A molding groove 102 is disposed at a bottom of the bin body 1, and the molding groove 102 is located inside the bin body 1.

Cavities 103 are defined at the bottom of the bin body 1. The cavities 103 are located outside the bin body 1 and arranged along edges of the groove 102.

Moreover, the garbage bin may further include a hanging hook 2. The hanging hook 2 is hung onto a bin wall of the bin body 1 by its own suspension hook portion 201. The solution storage chamber 5 is clamped on a load-bearing hook portion 202 of the hanging hook 2.

Figure 9:
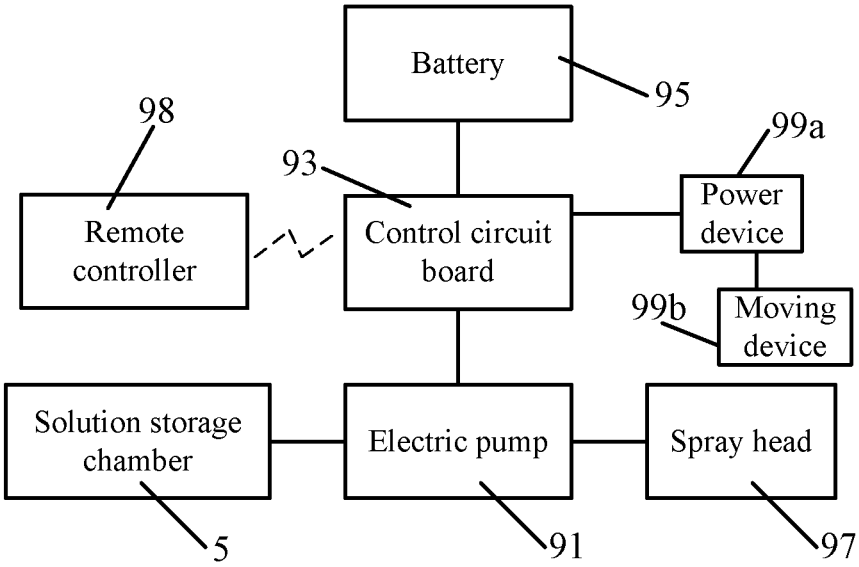
FIG. 9 illustrates connection relationships among several components of the garbage bin according to another embodiment of the present disclosure.

In addition, the garbage bin may further include an electric pump 91 and a battery 95. The solution storage chamber 5 is connected to the spray head 97 through the electric pump 91. In the illustrated embodiment, the solution storage chamber 5 and the bin body 1 are separated parts; and the electric pump 91, the battery 95 and a control circuit board 93 are all arranged on the solution storage chamber 5. In some embodiments, as illustrated in FIG. 9, a remote controller 98 may be provided to control functions of the control circuit board 93 wirelessly. The remote controller 98 can also be responsible for controlling a movement of the garbage bin through a power device 99*a* and a moving device 99*b* disposed on the garbage bin. For example, the power device 99*a* may include an electric motor, and the moving device 99*b* may include more than one wheel.

Hook tabs 101 are disposed on the bin body 1.

The bin cover includes a frame 3 and a cover plate 4. One end of the cover plate 4 is rotatably mounted on the frame 3 through a pin shaft and a torsion spring, and the other end of the cover plate 4 is detachably engaged with the frame 3 through a snap structure. A pressing plate can make the frame and the cover plate be snapped together or open the cover plate by a snap structure.

A nozzle of the spray head 97 is inclined towards a bin bottom side of the bin body 1.

The solution storage chamber 5 is fixedly provided with a spray seat 6. The spray seat 6 is defined a clamping hole 601 thereon. The clamping hole 601 is configured to clamp the spray head 97. One side of the clamping hole 601 is disposed with an arc-shaped liquid guide plate 602. The spray seat 6 is further disposed with a three-way groove 63 for clamping a three-way pipe, and a wiring groove 604 serving as a pipe groove and a cable groove.

Embodiment 2

On the basis of the embodiment 1, the embodiment 2 is further provided with an inner bucket, and the bin body in the embodiment 1 serves as an outer bucket. The inner bucket is placed in the outer bucket, a liquid storage cavity is defined at the bottom of the inner bucket, and thereby a double-bucket structure is achieved. The inner bucket may use or not use a plastic bag disclosed in the patent publication document CN211418370U.

Figure 5:
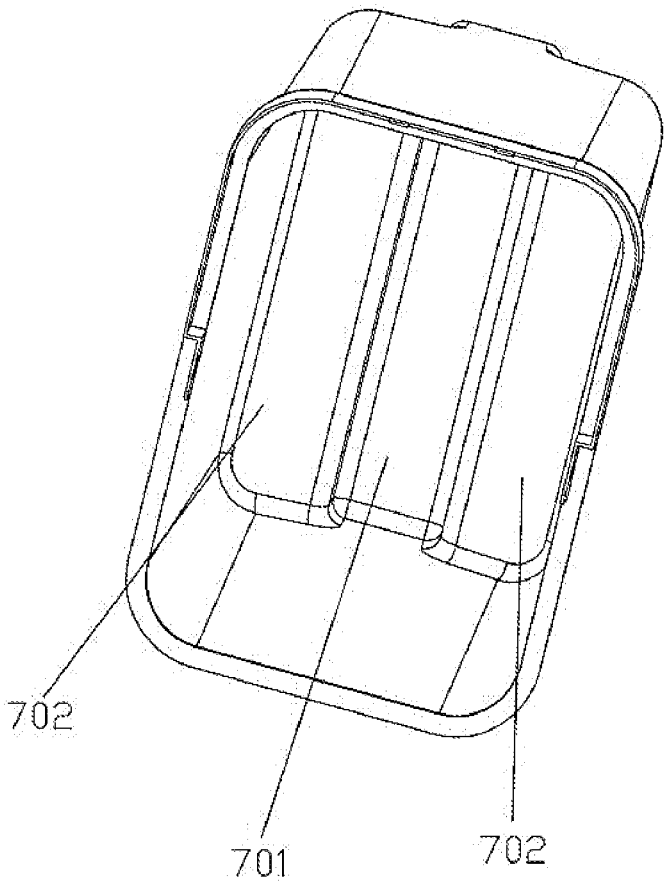
FIG. 5 illustrates a schematic structural view of an inner bucket.
Figure 6:
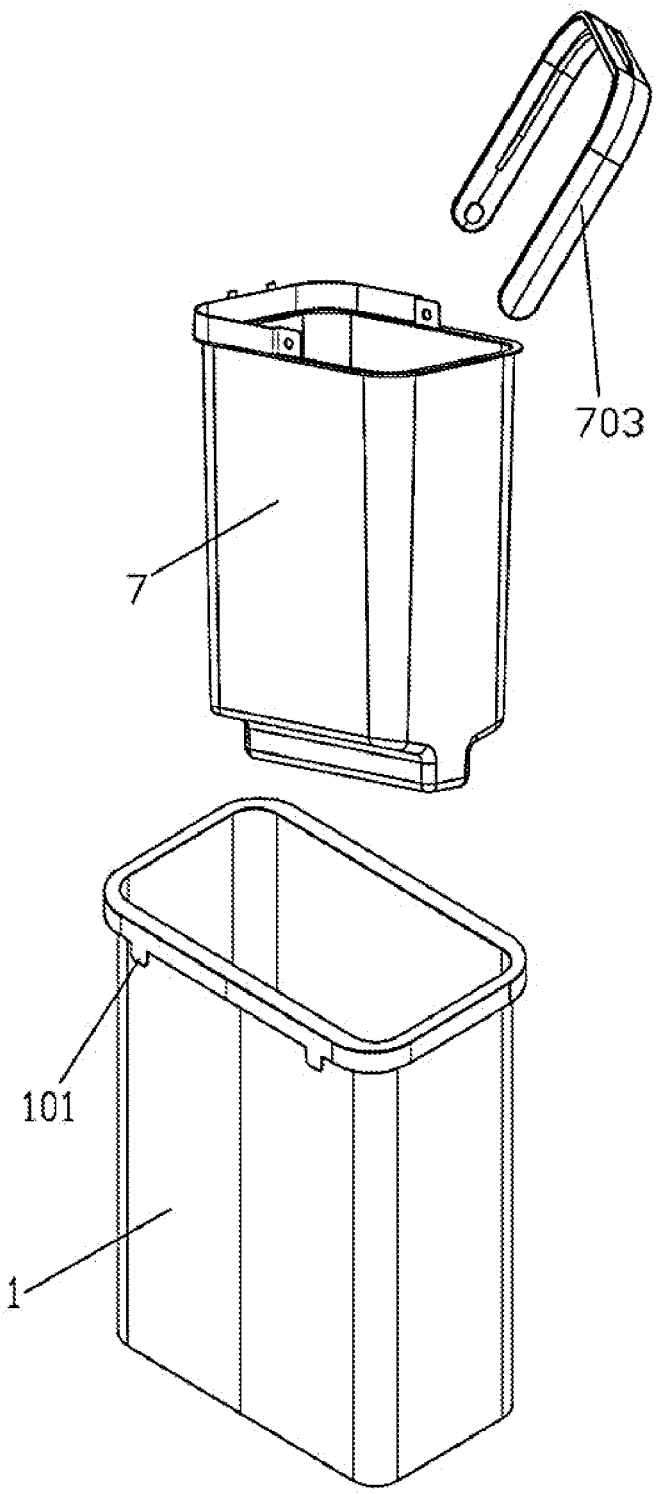
FIG. 6 illustrates a schematic assembly relationship between the inner bucket and the bin body.

A structure of the inner bucket is shown in FIG. 5 and FIG. 6. The bottom of the inner bucket 7 is provided with a downwardly concave liquid storage cavity 701, and the downwardly concave liquid storage cavity 701 can be directly embedded into the molding groove 102 of the bin body 1. Steps 702 are disposed on both sides of the liquid storage cavity 701. When in use, a filter plate (not shown in the drawings) can be arranged between the steps 701 on the both sides. When in use, kitchen garbage can be directly poured into the inner bucket, water in the garbage can flow into the liquid storage cavity 701 through the filter plate, and solid waste in the garbage can be blocked above the liquid storage cavity 701 by the filter plate.

It can be understood that the inner bucket may not be disposed with the filter plate, and directly uses the plastic bag disclosed in the patent publication document CN211418370U. The plastic bag is placed inside the inner bucket.

In order to facilitate access to the inner bucket 7, a handle 703 is arranged at the bucket mouth of the inner bucket 7.

Embodiment 3

On the basis of the embodiment 1, the embodiment 3 is further provided with a joint control structure. In particular, the control circuit board 93 is provided, a photoelectric sensor is arranged between the frame 3 and the cover plate 4, the photoelectric sensor is electrically connected to the control circuit board 93, the control circuit board 93 is electrically connected to the electric pump 91, and the photoelectric sensor is configured to detect whether the frame 3 and the cover plate 4 are closed together. When the photoelectric sensor detects the frame 3 and the cover plate being closed together, the control circuit board 93 can be triggered by a hand gesture to automatically open and close the bin cover, and activate a spraying mode as needed or in a timed and quantitative manner according to settings to spray a sterilization and deodorization solution to thereby carry out sterilization and deodorization on garbage in a garbage bag.

Figure 7:
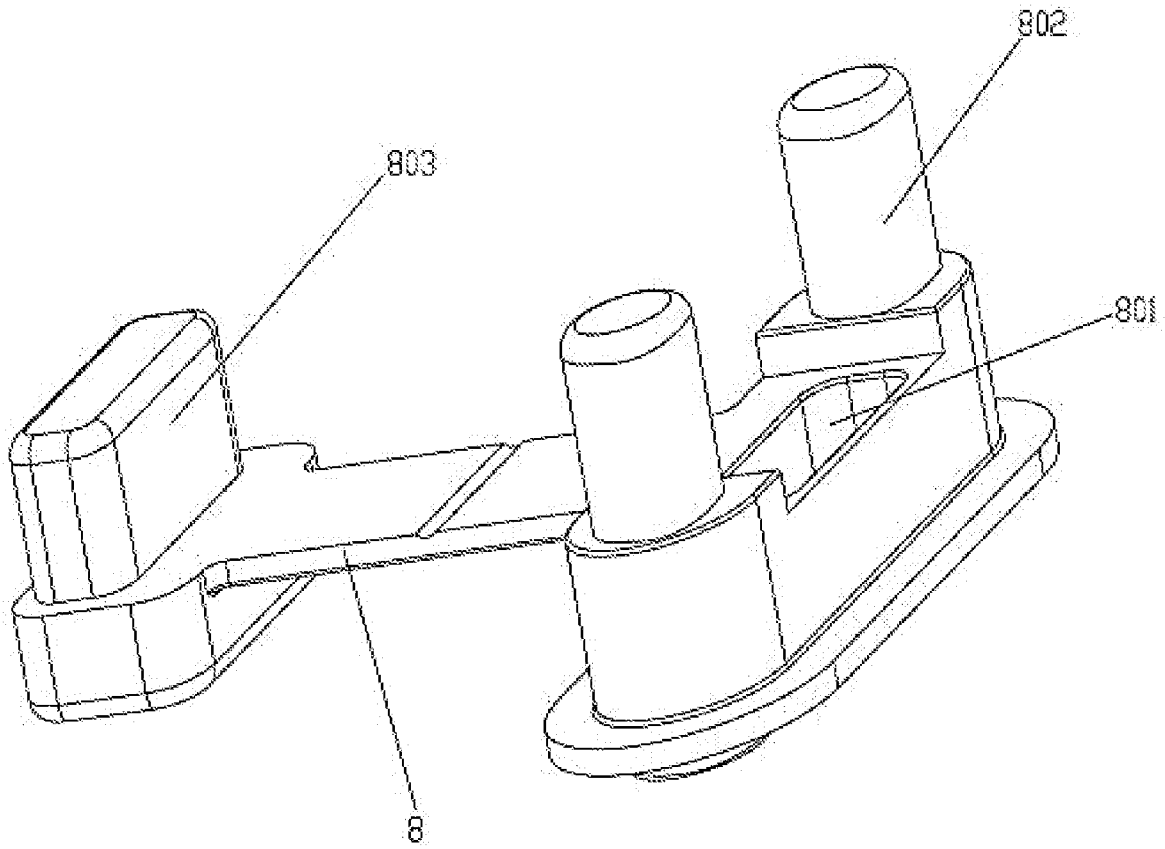
FIG. 7 illustrates a schematic structural view of a key-press board.
Figure 8:
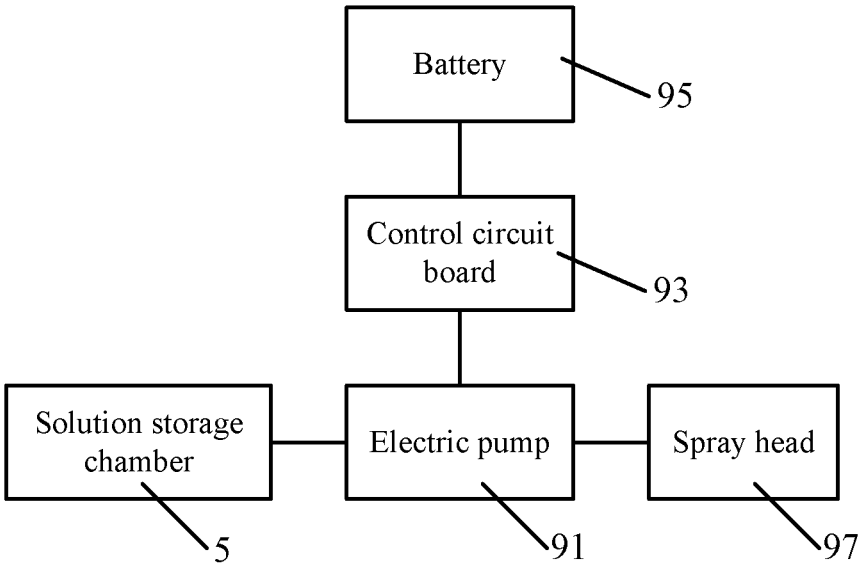
FIG. 8 illustrates connection relationships among several components of the garbage bin according to an embodiment of the present disclosure.

In addition, the control circuit board 93 may be disposed a key-press board 8 as shown in FIG. 7 thereon. The key-press board 8 is made of a soft rubber, and the key-press board 8 is provided with an end hole 801 for clamping a USB interface, and an end cover 803 for sealing the end hole 801 is attached to one side of the key-press board 8. The key-press board 8 is further provided with soft columns 802, through which touch keys on the control circuit board 93 can be pressed. The existence of the key-press board 8 can play a good waterproof role for the control circuit board 93 and effectively protect the damage of heavy objects on the keys.

Embodiment 4

On the basis of the embodiment 1, the embodiment 4 is further provided with electromagnet structures, that can attract and repel each other, between the frame 3 and the cover plate 4. By use of mutual attraction and repulsion of electromagnet structures, it can control the cover plate 4 to automatically open and close.

It should be noted that the "sterilization and deodorization solution" described in the above embodiment is essentially a mixture of a disinfectant solution and a deodorizing solution, which can kill harmful microorganisms and reduce the production of gases such as odor and carbon dioxide by killing microorganisms and decomposing odor.

The above description is only exemplary embodiments of the present disclosure and does not limit the scope of patent protection of the present disclosure. All equivalent structural transformations made by using contents of the specification and the accompanying drawings of the present disclosure, and directly or indirectly applying the contents of the specification and the accompanying drawings in other relevant technical fields, should be included in the scope of protection of the present disclosure.

What is claimed is:

1. An intelligent sterilization, deodorization and carbon-releasing reduction garbage bin, comprising: a bin body, a bin cover, a solution storage chamber, a spray head, an electric pump, a battery, and a control circuit board;

wherein the bin cover is disposed on the bin body;

wherein the spray head is disposed on one of a wall of the bin body and the bin cover;

wherein the solution storage chamber is arranged inside or outside the bin body;

wherein the solution storage chamber is connected to the spray head through the electric pump; the electric pump, the battery and the control circuit board are disposed on one of the solution storage chamber and the bin body; and the battery and the electric pump are electrically connected to the control circuit board;

wherein at least one of a molding groove and an inner bucket is disposed on the bin body;

wherein the garbage bin further comprises a spray seat, the spray seat is disposed on the solution storage chamber, the spray head is disposed on the spray seat; and the spray seat is provided with a three-way groove and a wiring groove.

2. The garbage bin according to claim 1, wherein the molding groove is disposed at a bottom of the bin body and located inside the bin body, and the molding groove is one of S-shaped, linear and Z-shaped.

3. The garbage bin according to claim 2, wherein cavities are disposed at the bottom of the bin body and located outside the bin body, and the cavities are arranged along edges of the molding groove.

4. The garbage bin according to claim 1, further comprising a hanging hook; wherein the hanging hook is detachably disposed on a bin wall of the bin body, and the solution storage chamber is detachably disposed on the hanging hook.

5. The garbage bin according to claim 1, wherein a liquid storage cavity is defined at a bottom of the inner bucket, a filter plate is disposed inside the inner bucket, and the inner bucket is provided with a handle.

6. The garbage bin according to claim 1, wherein the bin cover comprises a frame and a cover plate, and an end of the cover plate is rotatably mounted onto the frame.

7. The garbage bin according to claim 1, wherein a nozzle of the spray head is inclined towards a bin bottom side of the bin body.

8. The garbage bin according to claim 1, wherein the spray seat is disposed an arc-shaped liquid guide plate thereon.

9. The garbage bin according to claim 1, wherein a remote controller is provided and configured to control functions of the control circuit board wirelessly.

10. A garbage bin, comprising:

a bin body, wherein a molding groove is formed at a bottom of the bin body;

a bin cover, disposed on the bin body;

a solution storage chamber, detachably disposed on the bin body and configured to store a sterilization and deodorization solution;

a spray seat, disposed on the solution storage chamber; and a spray head, mounted on the spray seat and configured to spray the sterilization and deodorization solution into the bin body;

wherein the spray seat is provided with an arc-shaped liquid guide plate near a nozzle of the spray head; and the spray seat is provided with a three-way groove and a wiring groove.

11. The garbage bin according to claim 10, wherein cavities are disposed at the bottom of the bin body and located outside the bin body, and the cavities are arranged along edges of the molding groove.

12. The garbage bin according to claim 10, further comprising: a hanging hook; wherein the hanging hook comprises a suspension hook portion and a loadbearing hook portion at two opposite ends respectively, the hanging hook is detachably disposed on a bin wall of the bin body through the suspension hook portion, and the solution storage chamber is detachably disposed on the loadbearing hook portion.

13. The garbage bin according to claim 10, further comprising:

an inner bucket, configured to be placed in the bin body, wherein a liquid storage cavity is defined at a bottom of the inner bucket and downwardly recessed, and the liquid storage cavity is extended into the molding groove of the bin body when the inner bucket is placed in the bin body.

* * * * *